US007581336B2

(12) United States Patent
Segalin

(10) Patent No.: US 7,581,336 B2
(45) Date of Patent: Sep. 1, 2009

(54) SOLE FOR FOOTWEAR

(76) Inventor: Sergio Segalin, Via Cannaregio, 4084, 301031 Venezia (IT)

( * ) Notice: Subject to any disclaimer, the term of this patent is extended or adjusted under 35 U.S.C. 154(b) by 372 days.

(21) Appl. No.: 11/250,452

(22) Filed: Oct. 17, 2005

(65) Prior Publication Data

US 2006/0090377 A1 May 4, 2006

(30) Foreign Application Priority Data

Oct. 29, 2004 (IT) ..... TV2004A0123

(51) Int. Cl.
*A43B 13/40* (2006.01)

(52) U.S. Cl. ..... 36/43; 36/166; 36/173; 36/174; 36/180

(58) Field of Classification Search ..... 36/44, 36/43, 166, 145, 173, 174, 178, 180, 182, 36/181
See application file for complete search history.

(56) References Cited

U.S. PATENT DOCUMENTS 1,973,402 A * 9/1934 Bohmbach ..... 36/173
2,161,565 A * 6/1939 Freda ..... 36/180
2,221,202 A * 11/1940 Ratcliff ..... 36/155
2,423,622 A * 7/1947 Samblanet ..... 36/176
2,628,440 A * 2/1953 Leydecker ..... 36/180
2,828,555 A * 4/1958 Ledos ..... 36/176
4,266,553 A 5/1981 Faiella et al.
D259,675 S * 6/1981 Gordon et al. ..... D2/961
4,517,981 A 5/1985 Santopietro et al.
4,677,766 A 7/1987 Gudas et al.
5,611,153 A 3/1997 Fisher et al.

FOREIGN PATENT DOCUMENTS

FR 2 844 995 A 4/2004

* cited by examiner

*Primary Examiner*—Ted Kavanaugh
(74) *Attorney, Agent, or Firm*—Modiano & Associati; Albert Josif; Daniel J. O'Byrne

(57) ABSTRACT

A sole for footwear, formed by an upper surface which, on at least part of the heel region and the plantar arch region, at its outer edge, is lower than its inner edge. The highest point of the upper surface is arranged approximately at the radiographic projection of the scapho-cuneiform joint of the foot of the user on the sole.

20 Claims, 7 Drawing Sheets

SOLE FOR FOOTWEAR

The present invention relates to a sole for footwear.

BACKGROUND OF THE INVENTION

Feet, which are the human body's means for support and walking, have a complex structure capable of supporting the weight that bears on them both in static conditions and in dynamic conditions.

The complexity of this structure, dictated by the need to ensure the adaptability and flexibility required by a human being to stand upright, walk and run, requires a delicate balance, which if neglected can cause negative effects on the entire human body, such as for example excessive fatigue of the legs, lumbar pains, acquisition of an incorrect posture and/or gait, and many other muscular and spinal column disorders.

The shape of the sole of the foot is particularly important; due to its particular three-dimensional structure, by means of its anterior, lateral and posterior regions of the plantar surface, it constitutes the element for direct contact, also known as footprint, with the ground or with the insole of an item of footwear.

Accordingly, the footprint lacks the region related to the central surface, which due to the skeletal configuration of the anterior and posterior areas of the foot, which are supported by the action of the posterior tibial muscle, remains raised in an arc-like configuration, producing the so-called plantar arch.

The foot, as a whole, does not simply form a tripod, which would allow it to have exclusively static functions, but forms a three-dimensional architectural structure, comparable to a helix with a variable pitch, which is capable of coiling and uncoiling in accordance to the static and dynamic functions of the foot, accordingly affecting the plantar arch and therefore the shape of the footprint.

In order to ensure good functionality both in static conditions and during walking, said arch has a variable breadth.

While standing, said arch is in fact flattened in order to allow stable support, whereas while walking there is an alternation of contraction and distension of said arch, so as to achieve an effective dynamic balance.

The contraction or lifting of said arch and its distension are achieved respectively by means of the outward rotations, also known as supinations, and inward rotations, also known as pronations, of the calcaneum with respect to the tibia.

To allow this movement of the foot to yield the required results and therefore ensure the support of the human body without causing aches or fatigue thereof, the maximum and minimum breadths of the arch of the foot must be contained within very specific limits, which determine the morphological normality of the foot.

An excessive distension of the arch of the foot or an excessive contraction thereof may lead, moreover, to fatigue of the posterior tibial muscle, which is thus forced to contract excessively, transmitting a feeling of discomfort.

In order to improve the contact of the sole of the foot, plantar inserts are currently used which can be rendered more or less anatomically contoured by adding supports at the concave regions of the sole of said foot, said supports being suitable to lift passively the plantar arch, or by means of footwear correction devices, by assembling together with the plantar insert supports capable of redistributing in a targeted and case-specific manner the loads on specific points of the sole of the foot.

The main drawback of these known types of plantar insert is that the foot is prevented from performing certain natural and physiological movements, causing fatigue and discomfort.

Another drawback of known types of plantar insert relates to the fact that in most cases they are made to measure, requiring high production costs and the use of specialized labor.

Italian utility model No. 233568 is also known which discloses a regenerating anatomically-contoured plantar insert, in which the upper surface has a steep downward inclination in the outer region of the foot.

This regenerating anatomically-contoured plantar insert therefore induces an increased supination of the foot and therefore a lifting of the plantar arch of the foot, which is achieved without requiring the presence of protrusions that directly support said region of the sole of the foot.

However, even this solution does not solve all the drawbacks noted earlier.

SUMMARY OF THE INVENTION

The aim of the present invention is to provide a sole for footwear that allows to achieve an optimum level of comfort, reducing significantly the fatigue caused by prolonged standing or by long walks.

Within this aim, an object of the invention is to provide a sole for footwear that can be used both by users whose feet are within the normal morphological and functional range and by users whose feet have an excessive relaxation or contraction of the plantar arch.

Another object is to provide a sole that is structurally simple and has low manufacturing costs.

This aim and these objects, as well as others which will become better apparent hereinafter, are achieved by a sole for footwear, characterized in that it has an upper surface which, on at least part of the heel region and the plantar arch region, at its outer edge, is lower than its inner edge, the highest point of said upper surface being arranged approximately at the radiographic projection of the scapho-cuneiform joint of the foot of the user on said sole.

BRIEF DESCRIPTION OF THE DRAWINGS

Further characteristics and advantages of the invention will become better apparent from the following detailed description of a particular but not exclusive embodiment thereof, illustrated by way of non-limiting example in the accompanying drawings, wherein.

DESCRIPTION OF THE PREFERRED EMBODIMENTS

Figure 1:
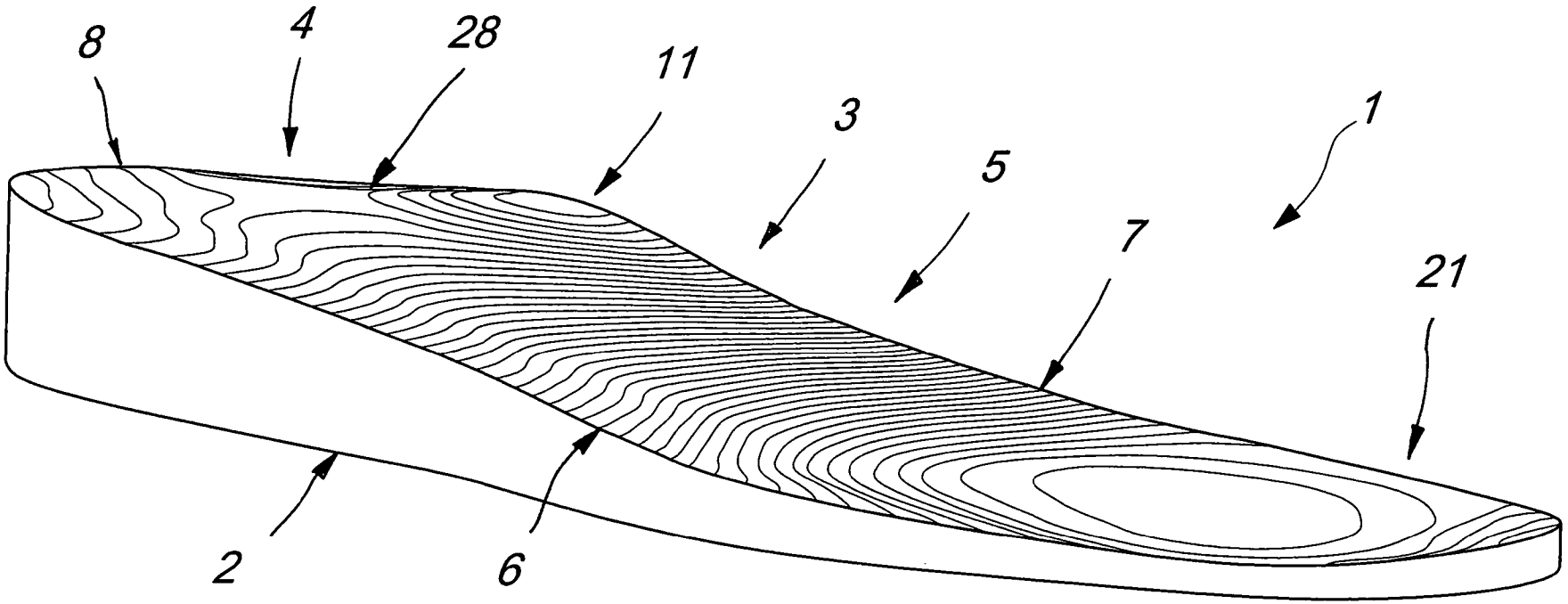
FIG. 1 is a perspective view of a sole for footwear according to the invention, on the upper surface of which the level contour lines related to its height are shown.
Figure 2:
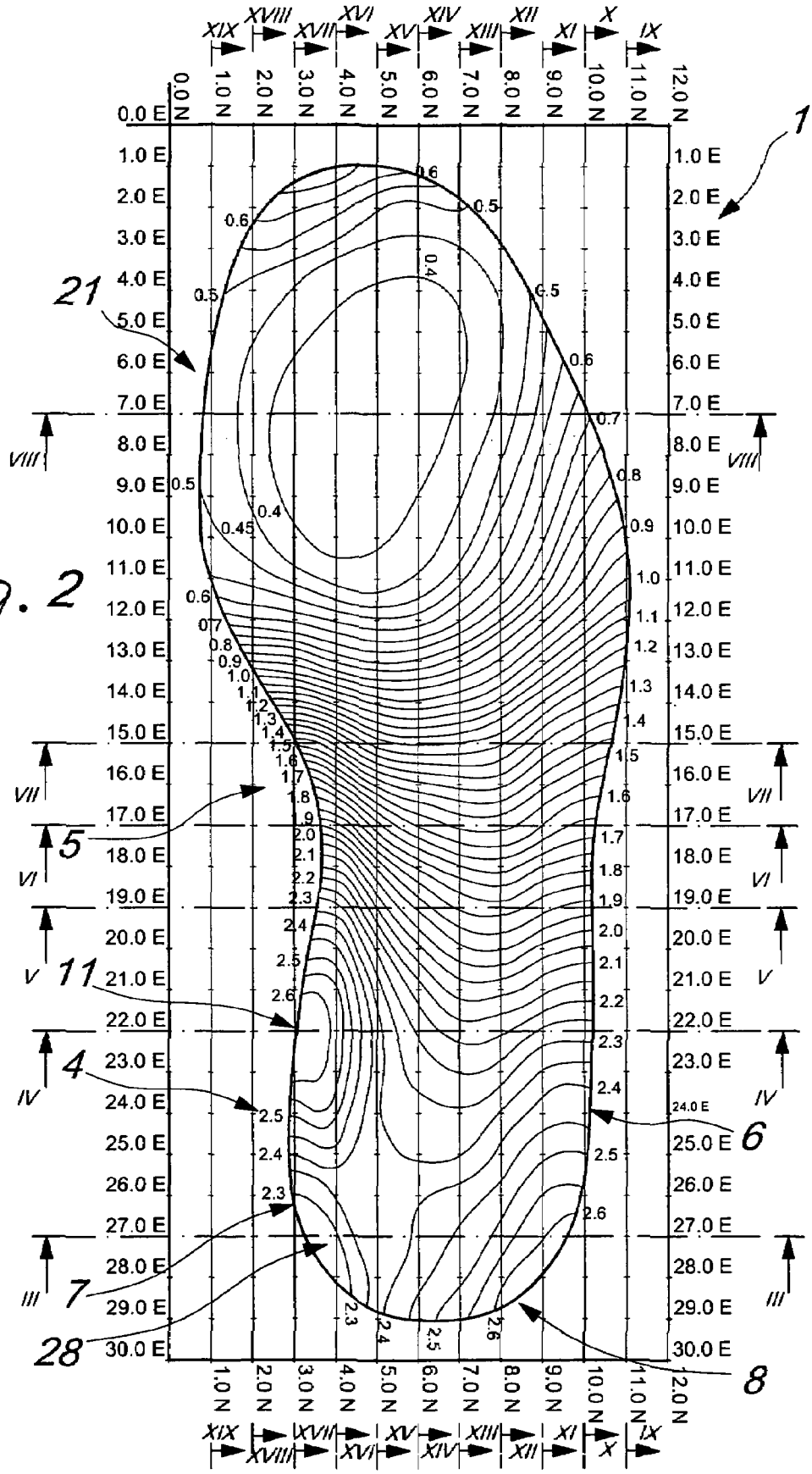
FIG. 2 is a top view of the sole on which the level contour lines related to the height of its upper surface are shown.

In the examples of embodiment that follow, individual characteristics, given in relation to specific examples, may actually be interchanged with other different characteristics that exist in other examples of embodiment.

Moreover, it is noted that anything found to be already known during the patenting process is understood not to be claimed and to be the subject of a disclaimer.

With reference to the figures, the reference numeral 1 designates a sole, which has an approximately flat lower face 2, while its upper surface 3 has, at least on part of the region of the heel 4 and of the region of the plantar arch 5, proximate to its outer edge 6, a lower height than it has proximate to its inner edge 7, the expressions "outer edge" and "inner edge" being used to designate the edges that lie respectively at the outer region and at the inner region of the foot of the user.

The shape of the upper surface 3 of the sole 1 is clearly shown in the accompanying figures, which illustrate a sole for a European size 42 shoe; such sole can be used as a template from which the proportions are to be deduced for providing a sole that can be used with footwear of any chosen different size, preferably comprised between sizes 34 and 51.

The numeric values indicated hereafter in relation to the height of the various regions of the upper surface 3 with respect to the lower face 2 must be considered as indicative of the differences in height between said regions or points of the various longitudinal and transverse profiles, and the entire upper surface can be shifted vertically upward or downward by a chosen value, which is equal for the entire upper surface 3, with respect to what has been described so far by way of example.

Figure 3:
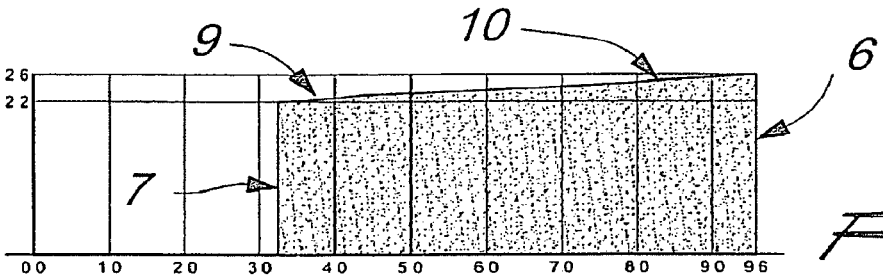
FIGS. 3, 4, 5, 6, 7 and 8 illustrate, in views taken respectively along the lines III-III, IV-IV, V-V, VI-VI, VII-VII and VIII-VIII of FIG. 2, the transverse profile of the sole in various points thereof.

As shown in FIG. 3, the upper surface 3 of the sole has, proximate to its rear end 8, a transverse profile which, starting from the inner edge 7, has a first approximately straight portion 9 of increasing height, which is blended with a second approximately straight portion 10 which rises with a smaller inclination than the first portion.

Proximate to the rear end 8, the sole therefore has, at its outer edge 6, a height, measured starting from the lower face 2, of approximately 2.6 centimeters, which is greater than that of its inner edge 7, which is approximately 2.2 centimeters.

At the heel region 4 that is adjacent to the rear end 8 and approximately at the region of the plantar arch 5, the sole has, at its outer edge 6, a lower height, measured starting from the lower face 2, than its inner edge 7.

The sole 1 has, approximately at the radiographic projection of the scapho-cuneiform joint of the foot of the user on said sole, a rise 11, which is arranged at the inner edge 7 of the sole 1, constitutes the highest point of the upper surface 3 with respect to the lower face 2, and is arranged at a height of approximately 2.6 centimeters with respect to the lower face 2.

Figure 4:
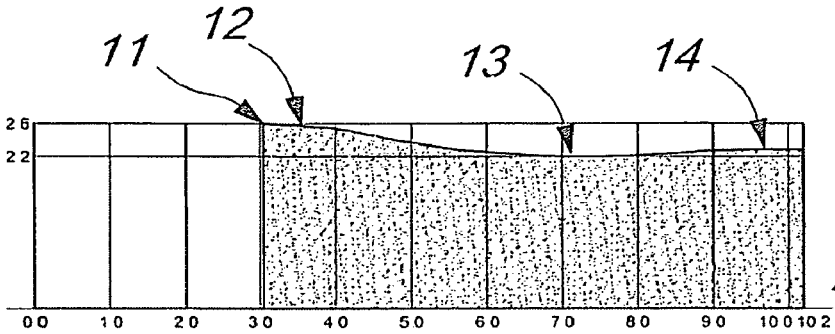

FIG. 4 illustrates the transverse profile of the sole 1 at the rise 11; said profile has, starting from the inner edge 7, a third curved and descending portion 12, which is blended with a fourth central portion 13, which is approximately flat and arranged closer to the outer edge than to the inner edge and has its lowest point at a height, with respect to the lower face 2, of approximately 2.2 centimeters; said fourth portion in turn is blended with a fifth curved portion 14, which rises slightly up to the outer edge 6.

At the plantar arch region 5, the upper surface 3 of the sole 1 has a configuration that slopes down longitudinally toward the tip.

Figure 5:
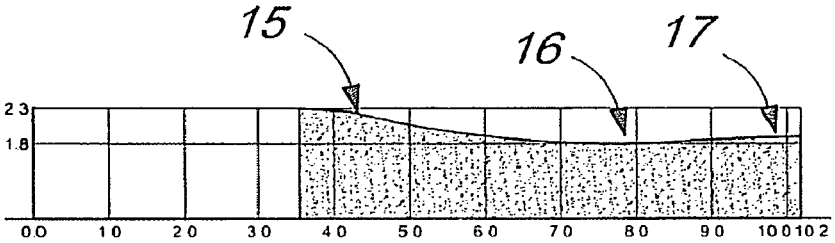

FIG. 5 illustrates the transverse profile of the sole 1 at a region of the plantar arch that is adjacent to the region of the heel 4; said profile has, starting from the inner edge 7, which is arranged at a height of approximately 2.3 centimeters with respect to the lower face 2, a sixth curved and descending portion 15, which is blended with a seventh portion 16, which is approximately flat and arranged closer to the outer edge than to the inner edge, its lowest point being at a height of approximately 1.8 centimeters with respect to the lower face 2; said seventh portion in turn is blended with an eighth portion 17, which is curved and rises slightly up to the outer edge 6.

Figure 6:
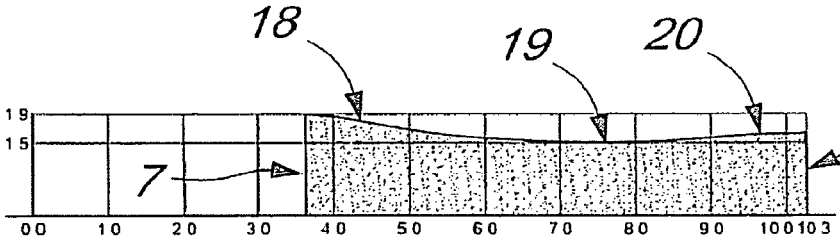

FIG. 6 illustrates the transverse profile of the sole 1 approximately at the central region of the plantar arch; said profile has, starting from the inner edge 7, which is arranged at a height of approximately 1.9 centimeters with respect to the lower face 2, a ninth curved and descending portion 18, which is blended with a tenth portion 19, which is approximately flat and arranged closer to the outer edge than to the inner edge, its lowest point being located at a height of approximately 1.5 centimeters with respect to the lower face 2; said tenth portion in turn is blended with an eleventh portion 20, which is curved and rises slightly up to the outer edge 6.

Figure 7:
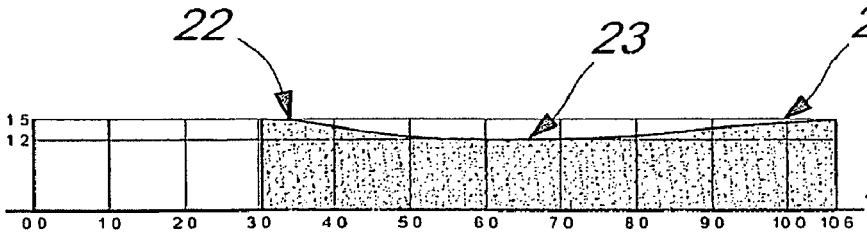

The transverse profile of the sole 1, approximately in the region of the plantar arch that is adjacent to the metatarsal region 21, is shown in FIG. 7, which shows that it is constituted by a twelfth curved portion 22, which descends starting from the inner edge 7, at which it has a height of approximately 1.5 centimeters with respect to the lower face 2.

A thirteenth portion 23 is blended with the twelfth portion, is approximately flat and lies closer to the inner edge than to the outer edge, its lowest point being at a height of approximately 1.2 centimeters with respect to the base 2; said thirteenth portion in turn is blended with a fourteenth portion 24, which is curved and rises slightly up to the outer edge 6, at which it has approximately the same height as the inner edge 7.

The upper surface 3 of the sole 1 has, approximately in the metatarsal region, proximate to its outer edge, a height, measured starting from the lower face 2, that is greater than the height of its inner edge.

Figure 8:
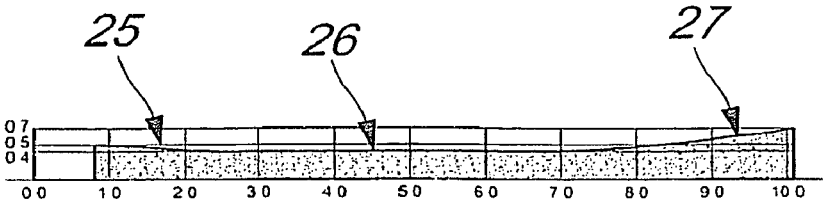
Figure 9:
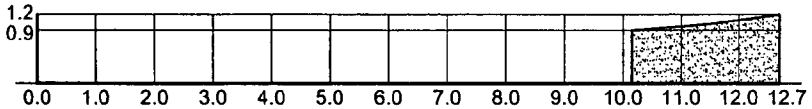
FIGS. 9, 10, 11, 12, 13, 14, 15, 16, 17, 18 and 19 illustrate, in views taken respectively along the lines IX-IX, X-X, XI-XI, XII-XII, XIII-XIII, XIV-XIV, XV-XV, XVI-XVI, XVII- XVII, XVIII-XVIII and XIX-XIX of FIG. 2, the longitudinal profile of the sole in various points thereof.
Figure 10:
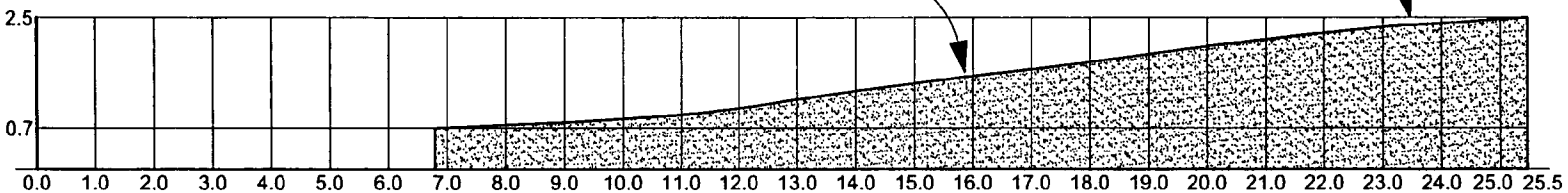
Figure 11:
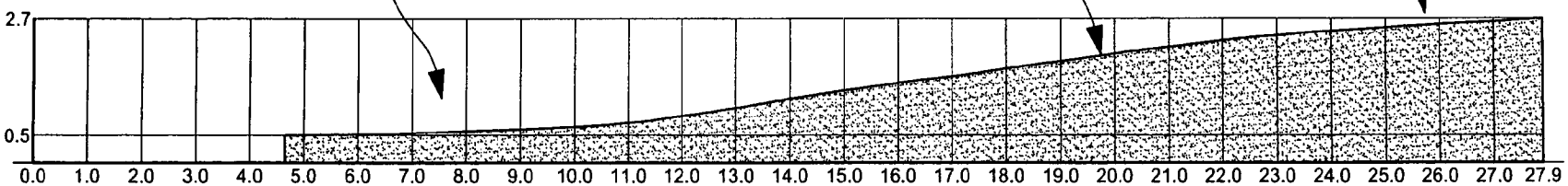
Figure 12:
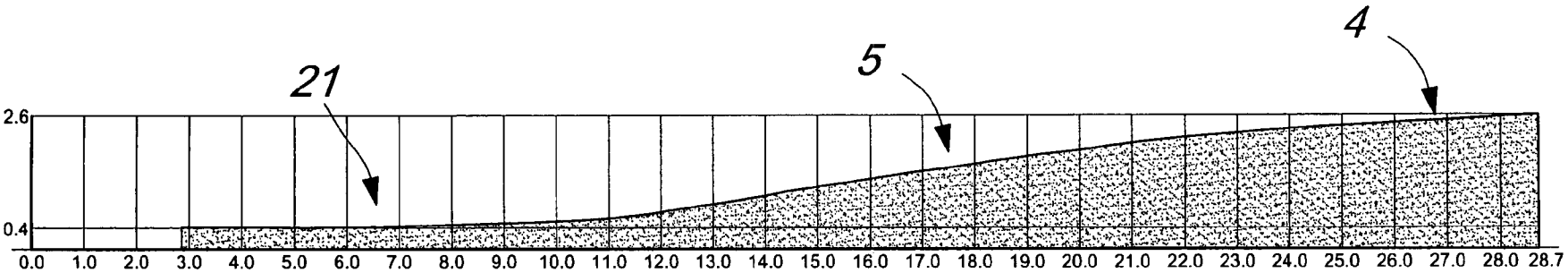
Figure 13:
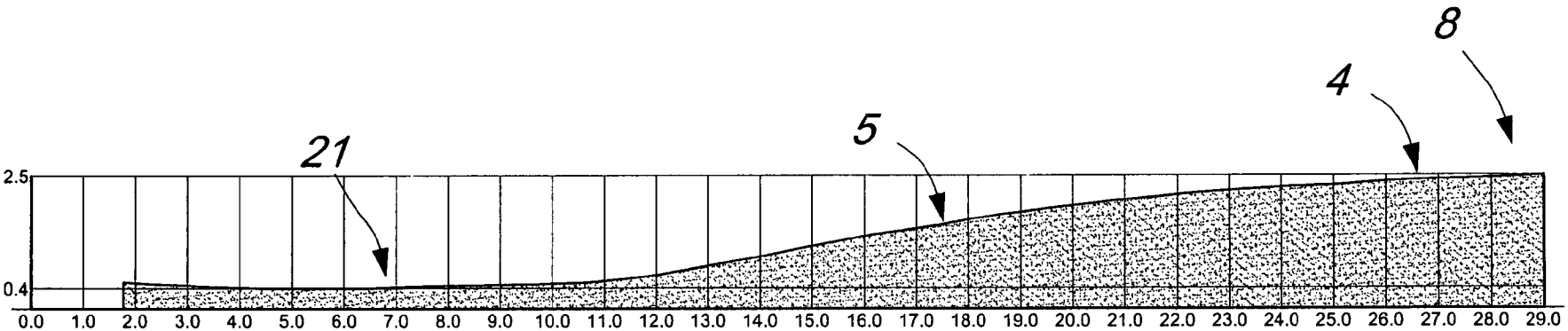
Figure 14:
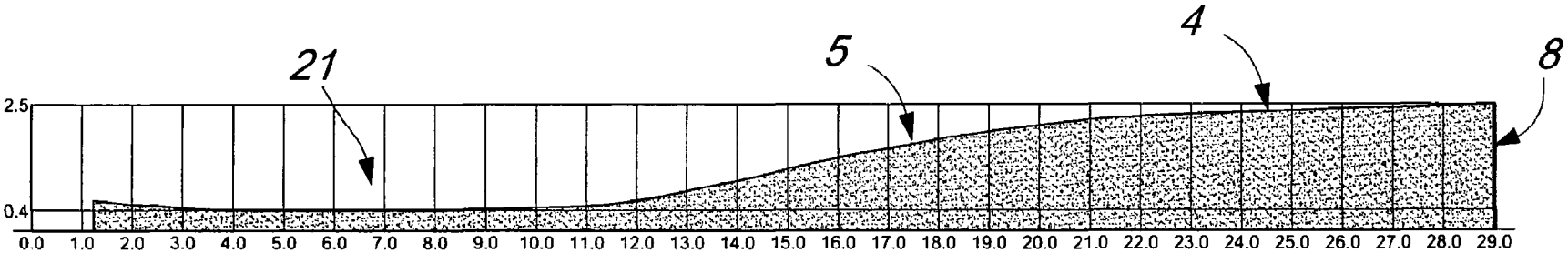
Figure 15:
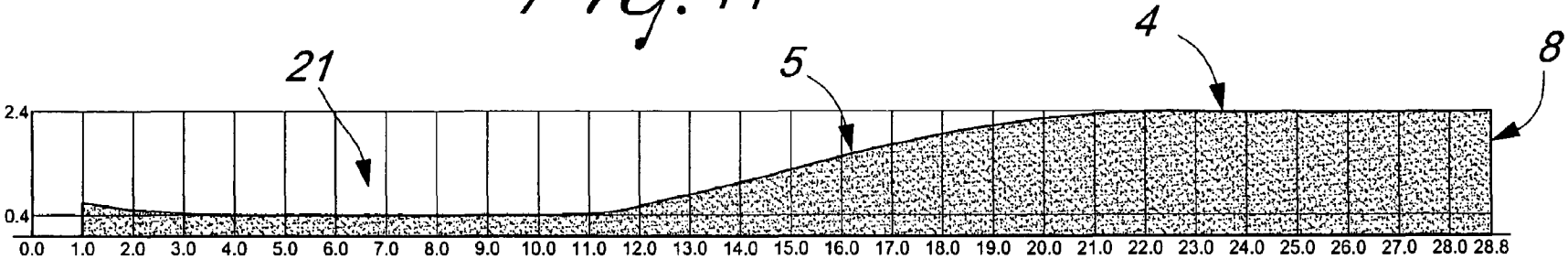

FIG. 8 is a view of the transverse profile of the upper surface 3 of the sole 1 at the metatarsal region 21; said profile has, starting from the inner edge 7, which is arranged at a height of approximately 0.5 centimeters with respect to the lower face 2, a fifteenth curved and descending portion 25, which is blended with a sixteenth approximately flat portion 26, which lies closer to the inner edge than to the outer edge and has its lowest point at a height of approximately 0.4 centimeters with respect to the lower face 2; said sixteenth portion in turn is blended with a seventeenth curved portion 27, which rises up to the outer edge 6, at which it has a height of approximately 0.7 centimeters with respect to the base 2.

FIGS. 9 to 19 illustrate the longitudinal profile of the sole 1 along a corresponding number of longitudinal sectional planes, which show that the upper surface 3 has a slightly concave shape at the metatarsal region 21.

In the region of the plantar arch 5, the longitudinal profile of the sole 1 instead has an inclined shape, which rises toward the heel region 4; the slope of the longitudinal profile in this region is greater proximate to the inner edge 7 of the sole 1 and decreases as one moves toward the outer edge 6.

Figure 16:
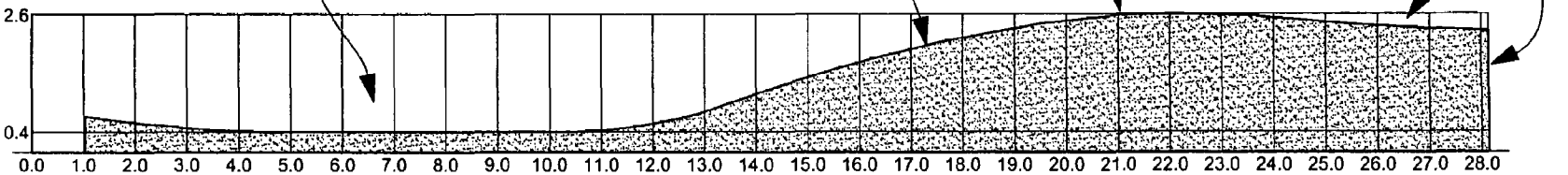
Figure 17:
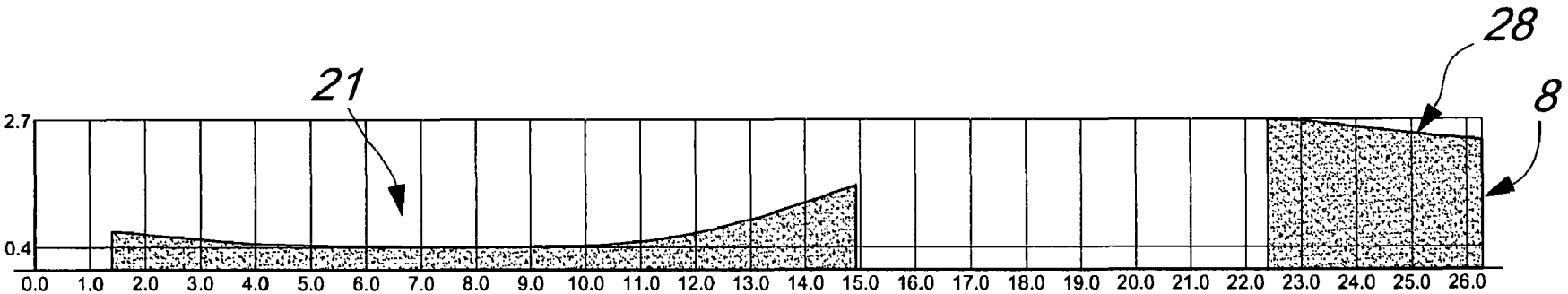
Figure 18:
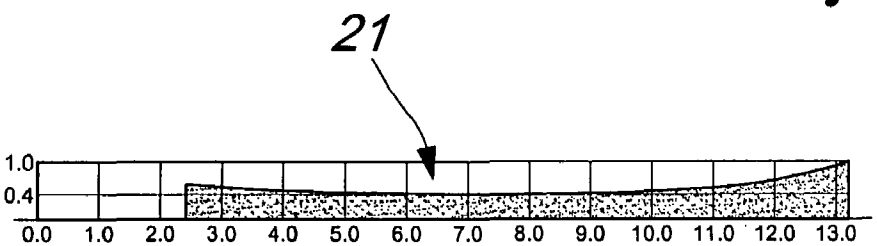
Figure 19:
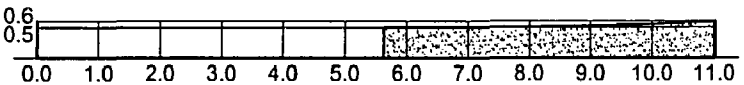

FIG. 16 illustrates, at the rear end 8 of the sole 1, a cavity 28, which can also be seen in FIG. 8 and is arranged at the inner edge 7.

The shape of the upper surface 3 of the sole 1 forces the foot of the user to perform a slight outward rotation of the calcaneum, also known as calcanear supination; accordingly, the foot acquires a posture that accompanies it dynamically in the natural helical coiling and uncoiling actions, facilitating it when standing upright for prolonged periods and preparing it appropriately to cope with dynamic conditions in walking.

In this manner, the posterior tibial muscle is positioned in an optimum manner, since it has neither an excessive contraction nor an excessive relaxation; this configuration therefore allows to prevent said muscle from being fatigued during long periods spent standing upright or walking.

It has thus been found that the invention has achieved the intended aim and objects, a sole having been provided which allows to obtain an optimum level of comfort, reducing significantly the fatigue arising from prolonged standing upright or from long walks.

Another object achieved by the invention is to be usable both by users whose feet are within the normal morphological and functional range and by users whose feet have an excessive relaxation or contraction of the plantar arch.

Another object achieved by the invention is to require no manufacturing to measure, therefore allowing a reduction of production costs.

The invention is of course susceptible of numerous modifications and variations, all of which are within the scope of the appended claims.

Thus, for example, it is possible to provide the sole 1 according to a stratified structure; in an advantageous but not unique embodiment, the sole is constituted by a bottom on which an insole is rigidly superimposed, the upper surface of the resulting sole being shaped according to what is described and illustrated in the accompanying drawings.

The materials used, as well as the dimensions that constitute the individual components of the invention, may of course be more pertinent according to the specific requirements.

The various means for performing certain different functions need not certainly coexist only in the illustrated embodiment but can be present per se in many embodiments, including ones that are not illustrated.

The characteristics indicated as advantageous, convenient or the like may also be omitted or be replaced by equivalents.

The disclosures in Italian Patent Application No. TV2004A000123, from which this application claims priority, are incorporated herein by reference.

What is claimed is:

1. A sole for footwear, having an upper surface which, on at least part of the heel region and the plantar arch region, at an outer edge thereof, is lower than an inner edge thereof, a highest point of said upper surface being arranged approximately at a point where a projection line of a scapho-cuneiform joint of the foot of the user, when the foot of the user rests on said sole, meets the sole, so as to obtain calcanear supination of the foot that prevents posterior tibial muscle from being fatigued during periods spent by the users standing upright or walking, said highest point of said upper surface being arranged coinciding with the inner edge of the sole, said upper surface decreasing in height just starting from said inner edge, toward the center of the sole, in a direction transverse to a longitudinal extension of the sole and then rising again to reach a height that is lower than the height of said inner edge but higher than the height of said center of the sole, and wherein said upper surface has, at a rear end thereof a depression arranged at said inner edge.

2. The sole of claim 1, wherein said sole has an approximately flat lower face, said upper surface having, proximate to said rear end thereof, a transverse profile constituted, starting from said inner edge, by a first portion, which is approximately straight and has an increasing height and is blended with a second portion, which is approximately straight and rises with a slope that is shallower than a slope of said first portion.

3. The sole of claim 2, wherein said sole has, at a heel region that is adjacent to said rear end and approximately at said plantar arch region, at said outer edge, a height, measured starting from said face, that is lower than the height of said inner edge.

4. The sole of claim 2, having, approximately at the projection of the scapho-cuneiform joint of the foot of the user on said sole, a rise, which is arranged at said inner edge and constitutes said highest point of said upper surface with respect to said lower face, said rise being arranged at a height of approximately 2.6 centimeters with respect to said lower face.

5. The sole of claim 4, having, at said rise, a transverse profile which is constituted, starting from said inner edge, by a third curved and descending portion, which is blended with a fourth central portion, which is approximately flat and arranged closer to said outer edge than to said inner edge, said fourth portion having its lowest point at a height of approximately 2.2 centimeters with respect to said lower face.

6. The sole of claim 5, wherein said fourth portion is blended with a fifth portion, which is curved and rises slightly up to said outer edge.

7. The sole of claim 6, having, at a region of the plantar arch that is adjacent to said heel region, a transverse profile constituted, starting from said inner edge, which is arranged at a height of approximately 2.3 centimeters with respect to said lower face, by a sixth curved and descending portion, which is blended with a seventh portion, which is approximately flat and arranged closer to said outer edge than to said inner edge, said seventh portion having its lowest point at a height of approximately 1.8 centimeters with respect to said lower face.

8. The sole of claim 7, wherein said seventh portion is blended with an eighth portion, which is curved and rises slightly up to said outer edge.

9. The sole of claim 8, having, approximately at the central region of the plantar arch, a transverse profile which is constituted, starting from said inner edge, which is arranged at a height of approximately 1.9 centimeters with respect to said lower face, by a ninth curved and descending portion, which is blended with a tenth portion which is approximately flat and arranged closer to said outer edge than to said inner edge, said tenth portion having its lowest point at a height of approximately 1.5 centimeters with respect to said lower face.

10. The sole of claim 9, wherein said tenth portion is blended with an eleventh curved portion, which rises slightly up to said outer edge.

11. The sole of claim 10, having, approximately in the region of the plantar arch that is adjacent to a metatarsal region, a transverse profile constituted by a twelfth curved portion, which descends starting from said inner edge, at which said profile has a height of approximately 1.5 centimeters with respect to said lower face.

12. The sole of claim 11, wherein said upper surface has, approximately in said metatarsal region, proximate to said outer edge, a height, measured starting from said lower face, which is greater than the height of said inner edge.

13. The sole of claim 11, wherein a thirteenth portion is blended with said twelfth portion, is approximately flat and is arranged closer to said inner edge than to said outer edge, said thirteenth portion having its lowest point at a height of approximately 1.2 centimeters with respect to said lower face.

14. The sole of claim 13, wherein said thirteenth portion is blended with a fourteenth portion, which is curved and rises slightly up to said outer edge, said outer edge having, approximately at said plantar arch region adjacent to said metatarsal region, approximately the same height as said inner edge.

15. The sole of claim 14, having, at said metatarsal region, a profile constituted, starting from said inner edge, which is arranged at a height of approximately 0.5 centimeters with respect to said base, by a fifteenth curved descending portion, which is blended with a sixteenth portion, which is approximately flat and arranged closer to said inner edge than to said outer edge.

16. The sole of claim 15, wherein said sixteenth portion has its lowest point at a height of approximately 0.4 centimeters with respect to said lower face and is blended with a seventeenth curved portion, which rises up to said outer edge, at which said seventeenth portion has a height of approximately 0.7 centimeters with respect to said lower face.

17. The sole of claim 16, wherein said upper surface has, at said metatarsal region, a slightly concave shape.

18. The sole of claim 17, wherein in said plantar arch region the longitudinal profile of said sole has an inclined shape which rises toward said heel region, the slope of said longitudinal profile in said plantar arch region being steeper proximate to said inner edge and shallower as one moves toward said outer edge.

19. The sole of claim 1, wherein said sole has, proximate to said rear end, at said outer edge, a height, measured starting from said lower face, of approximately 2.6 centimeters, which is greater than the height of said inner edge, which is approximately 2.2 centimeters.

20. The sole of claim 1, wherein said upper surface has, at said plantar arch region, a configuration that slopes down longitudinally toward a tip of said sole.

* * * * *

UNITED STATES PATENT AND TRADEMARK OFFICE

CERTIFICATE OF CORRECTION

PATENT NO. : 7,581,336 B2
APPLICATION NO. : 11/250452
DATED : September 1, 2009
INVENTOR(S) : Sergio Segalin It is certified that error appears in the above-identified patent and that said Letters Patent is hereby corrected as shown below:

On the Title Page Item (76), should read
Sergio Segalin, Via Cannaregio, 4084
30131 Venezia (IT)

Signed and Sealed this

Twenty-third Day of March, 2010

David J. Kappos

David J. Kappos
*Director of the United States Patent and Trademark Office*